US005244355A

United States Patent [19]

Fujii et al.

[11] Patent Number: 5,244,355

[45] Date of Patent: Sep. 14, 1993

[54] SWASH PLATE TYPE COMPRESSOR

[75] Inventors: Toshiro Fujii; Hayato Ikeda; Satoshi Umemura; Naoya Yokomachi; Kazuo Murakami; Koichi Ito; Kazuaki Iwama; Shoji Takemoto; Hideo Mori, all of Kariya, Japan

[73] Assignee: Kabushiki Kaisha Toyoda Jidoshokki Seisakusho, Kariya, Japan

[21] Appl. No.: 927,133

[22] Filed: Aug. 7, 1992

Related U.S. Application Data

[63] Continuation-in-part of Ser. No. 884,721, May 18, 1992, Pat. No. 5,207,563, and a continuation-in-part of Ser. No. 880,574, May 8, 1992, Pat. No. 5,183,394, and a continuation-in-part of Ser. No. 863,814, Apr. 6, 1992, Pat. No. 5,178,521, and a continuation-in-part of Ser. No. 917,451, Jul. 21, 1992, Pat. No. 5,181,834.

[30] Foreign Application Priority Data

| | | | |
|---|---|---|---|
| Aug. 9, 1991 | [JP] | Japan | 3-200962 |
| Aug. 12, 1991 | [JP] | Japan | 3-201635 |
| Sep. 5, 1991 | [JP] | Japan | 3-225989 |

[51] Int. Cl.[5] ..... F04B 1/12

[52] U.S. Cl. ..... 417/269

[58] Field of Search ..... 417/269

[56] References Cited

U.S. PATENT DOCUMENTS

| | | | |
|---|---|---|---|
| 2,479,876 | 8/1949 | Sherman . | |
| 5,052,898 | 10/1991 | Cook | 417/269 |

FOREIGN PATENT DOCUMENTS

| | | | |
|---|---|---|---|
| 54-55711 | 4/1979 | Japan . | |
| 203883 | 12/1982 | Japan | 417/269 |
| 280876 | 11/1988 | Japan | 417/269 |
| 3-92587 | 4/1991 | Japan . | |

*Primary Examiner*—Richard A. Bertsch
*Assistant Examiner*—Alfred Basichas
*Attorney, Agent, or Firm*—Brooks Haidt Haffner & Delahunty

[57] ABSTRACT

A swash plate type compressor includes a cylinder blocks having a crank case which communicates with a suction port and a plurality of bores formed therein. The ends of each bore are covered with a pair of housings. The bores communicate with discharge chambers. A drive shaft is rotatably placed within the cylinder blocks. A swash plate is rotatable in the crank case, and is mounted on the drive shaft. A plurality of pistons are drivably coupled to the swash plate, and are reciprocotable in their respective bores. As the pistons reciprocate, a refrigerant in the crank case is sucked into each bore and is compressed therein. The compressed refrigerant is discharged into the discharge chambers from the bores. A passage for transporting the refrigerant between the discharge chambers is formed along the axis of the drive shaft. Seals are provided between the cylinder blocks and the drive shaft for sealing the gap between the discharge chambers and the crank case.

19 Claims, 16 Drawing Sheets

SWASH PLATE TYPE COMPRESSOR

CROSS REFERENCE TO RELATED APPLICATIONS

This is a continuation in part application of the U.S. application Ser. Nos. 07/884,721 filed on May 18, 1992, now U.S. Pat. No. 5,207,563, Ser No. 07/880,574 filed on May 8, 1992, now U.S. Pat. No. 5,183,394, Ser. No. 07/863,814 filed on Apr. 6, 1992, now U.S. Pat. No. 5,178,521, and 07/917,451 filed on Jul. 21, 1992, now U.S. Pat. No. 5,181,834, entitled SWASH PLATE TYPE COMPRESSOR, which are incorporated herein by reference.

BACKGROUND OF THE INVENTION

This application claims the priority of Japanese Patent Application Nos. 3-200962 filed Aug. 9, 1991, 3-201635 filed Aug. 12, 1991, and 3-225989 filed Sep. 5, 1991, which are incorporated herein by reference.

FIELD OF THE INVENTION

The present invention relates to an improved swash plate type compressor suitable for use in a vehicle air conditioning system.

DESCRIPTION OF THE RELATED ART

Japanese Unexamined Patent Publication No. 3-92587 discloses a swash plate type compressor which includes a front and rear cylinder blocks. A crank case is connected to a refrigerant suction port, and is located at an interface section between the front and rear cylinder blocks. Each cylinder block has a distal end which is covered by a corresponding housing section. A front valve plate is disposed intermediate the front cylinder block and the front housing section. Similarly, a rear valve plate is disposed intermediate the rear cylinder block and the rear housing section. Each housing sections includes a suction chamber and a discharge chamber. The discharge chamber leads to a refrigerant discharge port.

A drive shaft rotatably enters through an axial opening in the front and rear cylinder blocks. A swash plate is fixedly mounted on the drive shaft and is rotatably disposed within the crank case. The valve plates include suction ports which connect the suction chambers to a plurality of cylinders, via corresponding suction valves. Each valve plate also has a discharge port which connects each discharge chamber with each cylinder via a discharge valve. Each cylinder block has a plurality of suction passages which connect the crank case to the front and rear suction chambers, and a discharge passage which interconnects the front and rear discharge chambers.

The discharge passage is located such that the discharge passage does not interfere with the suction passage and the crank case. Due to design restrictions, such as the limited outer dimensions, the discharge passage has to be positioned close to the suction passage. In this arrangement, however, the refrigerant flows from the refrigerating circuit to the crank case and the suction passage, through the suction ports. The refrigerant absorbs heat from the hot and compressed refrigerant flowing through the discharge passage. The refrigerant is compressed to a higher temperature and is then discharged. As a result, the circulation of the discharged heated refrigerant increases the load on the refrigerating circuit, thus lowering its cooling ability and the overall efficiency of the compressor.

SUMMARY OF THE INVENTION

It is therefore an object of the present invention to minimize the overheating of a refrigerant, while securing an airtight sealing of the discharge chamber.

To achieve the foregoing objects, the swash plate type compressor of the present invention includes cylinder blocks having a crank case which communicates with a plurality of suction ports and a plurality of bores. Both ends of each bore are sealed with a pair of housings. The bores communicate with the discharge chambers. A drive shaft is rotatably placed in the cylinder blocks. A swash plate is mounted on the drive shaft within the crank case.

A plurality of pistons are drivably coupled to the swash plate, and reciprocate in their respective bores. As the pistons reciprocate, the refrigerant in the crank case is sucked into each bore to be compressed therein, and the compressed refrigerant is discharged into the discharge chambers from the bores. A passage for feeding the refrigerant between the discharge chambers is formed along the axis of the drive shaft. Seals are provided between the cylinder blocks and the drive shaft, to intercept the communications between the discharge chambers and the crank case.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A first embodiment of the present invention will now be described with reference to the accompanying drawings.

Figure 1:
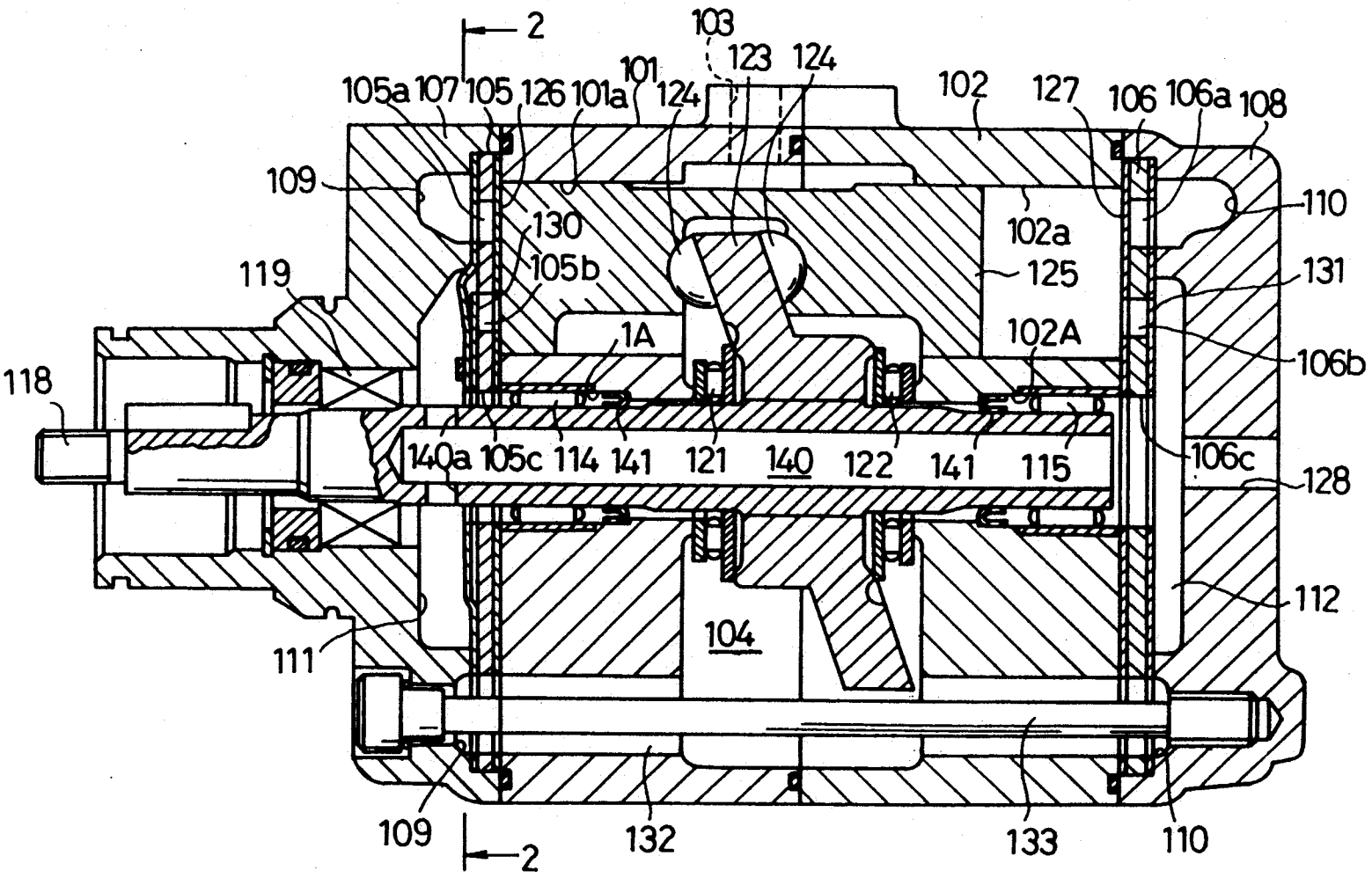
FIG. 1 is a cross-sectional view of a swash plate type compressor according to a first embodiment of the present invention.
Figure 2:
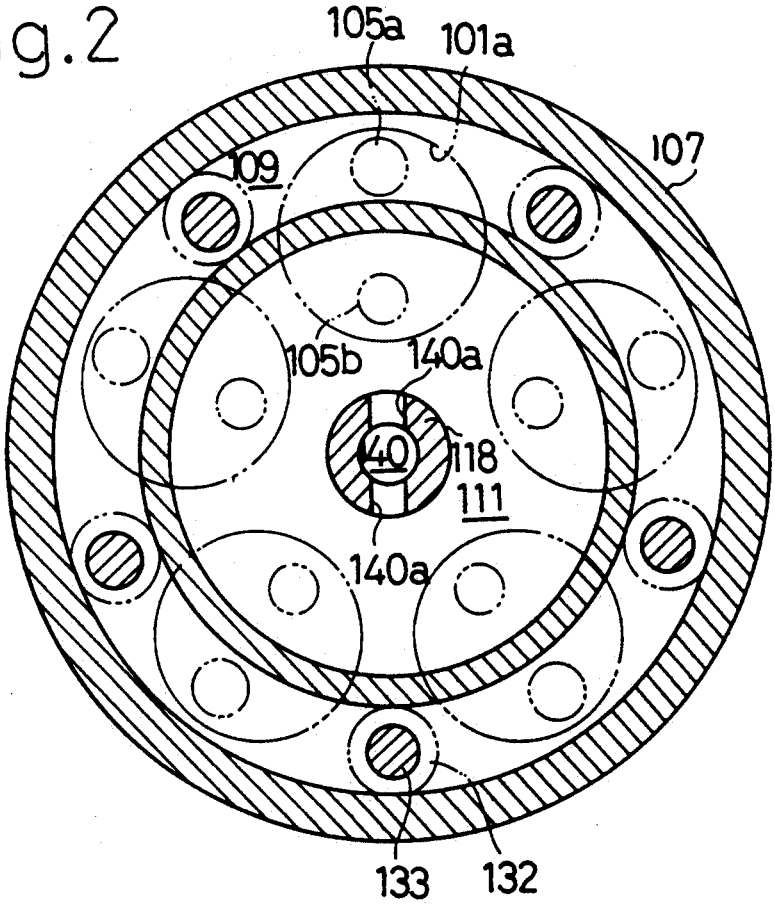
FIG. 2 is a cross sectional view of the compressor in FIG. 1 taken along line 2—2.

FIG. 1 illustrates a front cylinder block 101 and a rear cylinder block 102 which are combined with each other in axial alignment to form a unitary cylinder block. A crank case 104 is formed intermediate the front and rear cylinder blocks 101 and 102, and communicates with a refrigerant inlet port 103. The ends of the unitary cylinder block are closed with a front housing 107 and a rear housing 108, via valve plates 105 and 106 respectively. As shown in FIG. 2, a ring-shaped front suction chamber 109 is formed in the inner peripheral portion of the front housing 107, and a concentric front discharge chamber 111 is formed in the inner central section. The front discharge chamber 111 encloses the outer surface of a drive shaft 118. Similarly, a rear suction chamber 110 is formed in the inner peripheral portion of the rear housing 108, and a concentric rear discharge chamber 112 is formed in the central section.

The drive shaft 118 is fitted rotatably within two axial bores 101A and 102A of the cylinder blocks 101 and 102, via radial bearings 114 and 115. This drive shaft 118 penetrates through an opening 105c in the front valve plate 105, and extends outwardly through the outer end of the front housing 107 via a seal 119.

A swash plate 123 is rotatably disposed in the crank case 104, and is securely mounted on the drive shaft 118. This swash plate 123 is connected to both cylinder blocks 101 and 102 by means of thrust bearings 121 and 122. The front cylinder block 101 includes a plurality of axially extending bore 101a which are arranged equidistantly around the drive shaft 118. Similarly, the rear cylinder block 102 has a plurality of axially extending bores 102a which are arranged equidistantly around the drive shaft 118. A two-head piston 125 reciprocates in each pair of the bores 101a and 102a. Each piston 125 is engaged with the swash plate 123, via a pair of shoes 124.

The suction port 105a is formed in the front valve plate 105, and connects the front suction chamber 109, via a suction valve 126, to the bores 101a. Similarly, the rear valve plate 106 has a rear suction port 106a formed therein, to connect the rear suction chamber 110, via a suction valve 127, to the bores 102a. The valve plate 105 also includes a discharge port 105b which connects the front discharge chamber 111, via a discharge valve 130, to the bores 101a.

Similarly, the rear valve plate 106 includes a discharge port 106b which connects the rear discharge chamber 112, via a discharge valve 131, to the bores 102a. A plurality of suction passages 132 are formed along the outer peripheral portions of the cylinder blocks 101 and 102, in order to connect the crank case 104 to both suction chambers 109 and 110. A plurality of bolts 133 are fitted into the respective suction passages 132 to connect the front and rear housings 107 and 108.

A discharge port 128 is formed in the rear housing 108, and is generally aligned with discharge passage 140. The discharge port 128 communicates with the rear discharge chamber 112. The discharge chamber 112 also communicates with the axial bore 102A of the rear cylinder block 102, via an opening 106c in the valve plate 106.

The discharge passage 140 in the present embodiment is axially formed within the drive shaft 118. The discharge passage 140 has one of its ends communicating with the axis bore 102A. At the other end of the discharge passage 140, a plurality of through holes 140a are formed in the drive shaft 118, and extend in the radial direction. The through holes 140a communicate with the discharge passage 140 and the discharge chamber 111.

Figure 3:
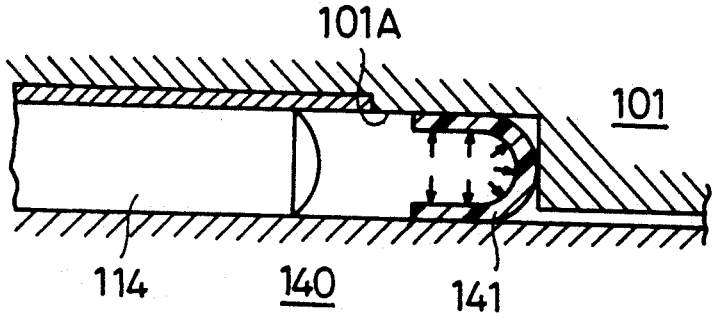
FIG. 3 is an enlarged cross-sectional view illustrating part of a seal for use in the compressor of FIG. 1.

Ring-shaped seals 141 are fitted in the axial bores 101A and 102A of the cylinder blocks 101 and 102. Each of the seals 141 has a generally U-shaped cross section, as shown in FIG. 3, and has its opening face the discharge chambers 111 and 112. Due to the high pressure in the discharge chambers 111 and 112, the seals 141 are forced against the inner ends of the respective axial bores 101A and 102A. The seals 141 are in close contact with the outer surface of the drive shaft 118 and the inner walls of the axial bores 101A and 102A. This sealing arrangement seals the discharge chambers 111 and 112 crank case 104, prevents leakage therebetween.

The refrigerant that circulates back to the compressor via the inlet port 103 from an external refrigerating circuit, flows into the crank case 104. Then, the refrigerant is guided, via the individual suction passages 132, to the front and rear suction chambers 109 and 110. Meanwhile, the individual pistons 125 reciprocate in the respective bores 101a and 102a, via the swash plate 123 which rotates together with the drive shaft 118.

Accordingly, the refrigerant in the suction chambers 109 and 110 are drawn, via the suction ports 105a and 106a of the valve plates 105 and 106, into those bores 101a and 102a whose volumes are increasing. The compressed refrigerant is discharged, via the discharge ports 105b and 106b of the valve plates 105 and 106, to the front and rear discharge chambers 111 and 112, from those bores 101a and 102a whose volumes are decreasing.

The compressed refrigerant discharged into the front discharge chamber 111, is drawn via the through holes 140a into the discharge passage 140. The refrigerant further flows, via the opening 106c, and joins the compressed refrigerant in the rear discharge chamber 112. The combined refrigerant is discharged through the discharge port 128 to an outer refrigerant circuit including a condenser (not shown).

Particularly, the discharge passage 140 is formed in the drive shaft 118, so that the refrigerant flowing through the crank case 104 and the suction passages 132 is sufficiently insulated and remotely disposed from the heat from the discharge passage 140 (hot refrigerant). Experiments have shown that, when the temperature of the discharged refrigerant with respect to the number of rotations of the compressor of the present invention is compared to the temperature of the refrigerant in a conventional compressor, the temperature of the present compressor is about 5° C. lower at a speed ranging from 1000 to 3000 rpm.

Further, since the discharge passage 140 is formed in the drive shaft 118 in this embodiment, the outer ends of the axis bores 101A and 102A communicate with the discharge chambers under high pressure, and the inner ends thereof communicate with the crank case 104 under low pressure. The crank case 104 and the discharge chambers 111 and 112 are separated in a fluid tight manner, by the seals 141. The refrigerant is thus prevented from leaking into the crank case 104 from each discharge chamber.

In particular, each of the seals 141 has a U-shaped cross section with two substantially parallel edges which are forced in close contact with the inner walls of the axial bores 101A and 102A and the outer surface of the drive shaft 118 under the pressure in the discharge chambers. The applied pressure to the seal 141 for causing it tightly to contact the associated axial bore and the drive shaft 118 increases proportionally to the pressure in the corresponding discharge chamber. Therefore, the seals 141 provide an effective seal.

The compressor of the present embodiment uses the interior of the drive shaft as the discharge passage, so that the discharge passage can be formed at a position where it does not interfere with the bores, without increasing the outer diameter of the compressor. This feature renders the compressor lighter and more compact, while maintaining a predetermined compressing capacity.

Figure 4:
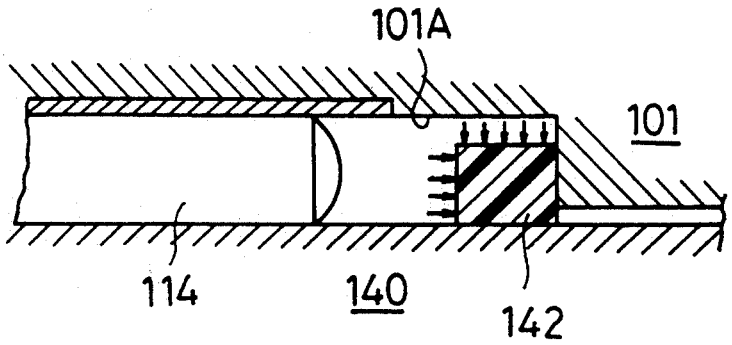
FIG. 4 is an enlarged cross-sectional view showing a modification of the seal of FIG. 3.

FIG. 4 illustrates a modification to the seal. The modified seal 142 has a generally rectangular or square cross section, and is fitted over the drive shaft 118. The pressure in the discharge chambers 111 and 112 acts on the outer surfaces and outer end faces of the seals 142, for causing the seals 142 to be forced against the inner ends of the axial bores 101A and 102A.

Figure 5:
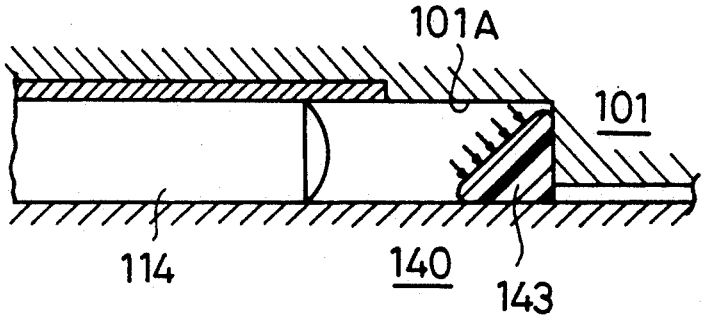
FIG. 5 is an enlarged cross-sectional view illustrating another modification of the seal of FIGS. 3 and 4.
Figure 6:
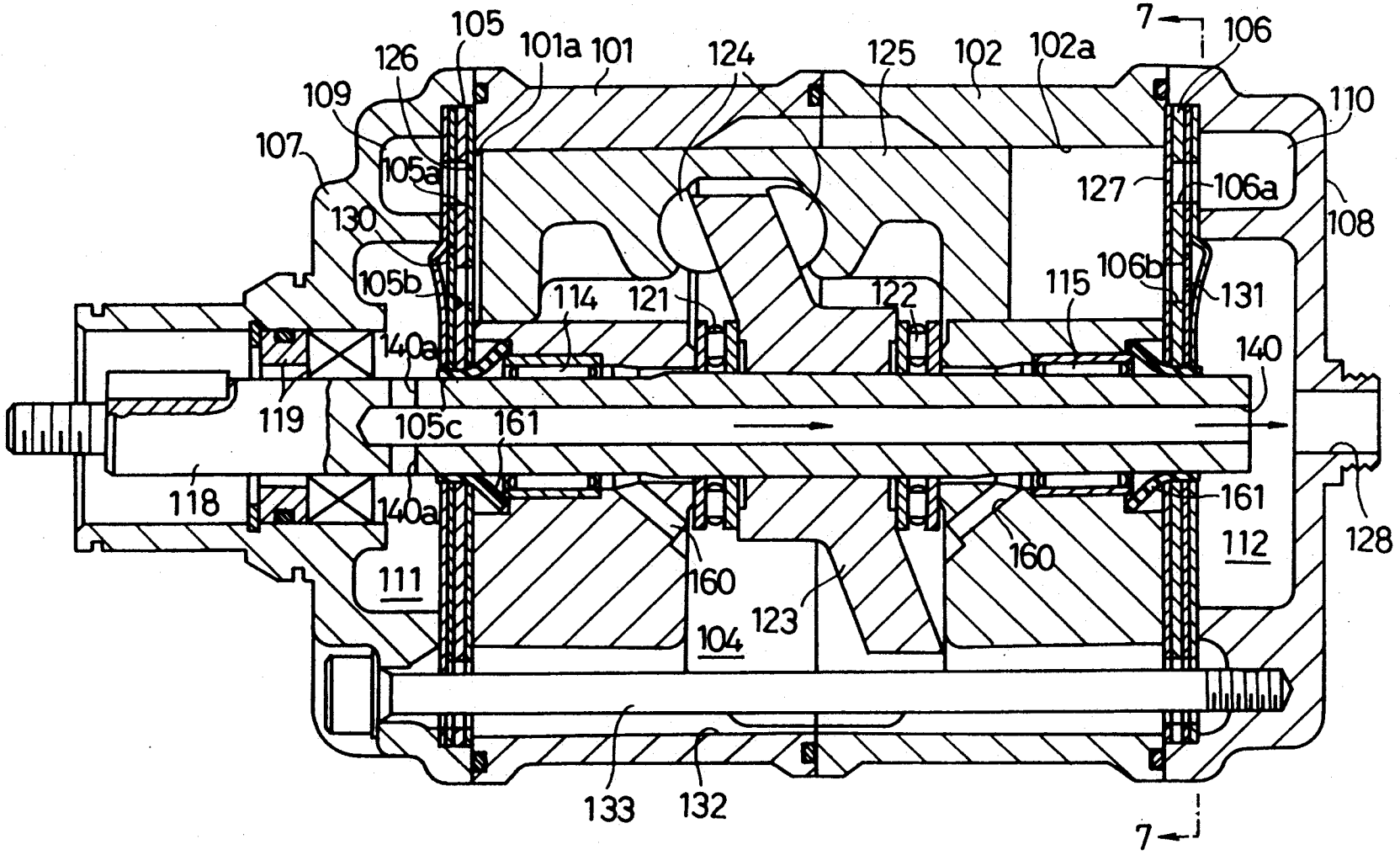
FIG. 6 is a cross-sectional view of a swash plate type compressor according to a second embodiment of the present invention.

FIG. 5 illustrates another modification to the seal. The modified seal 143 has a generally triangular cross section, and is fitted over the drive shaft 118. The pressures in the discharge chambers 111 and 112 act on the inclined surfaces of the seals 143, for pressing the inner surfaces and inner end faces of the seals 143, respectively, against the outer surface of the drive shaft 118 and the inner ends of the axial bores 101A and 102A. Both modifications prevent the refrigerants from leaking from the discharge chambers 111 and 112 to the crank case 104.

Figure 7:
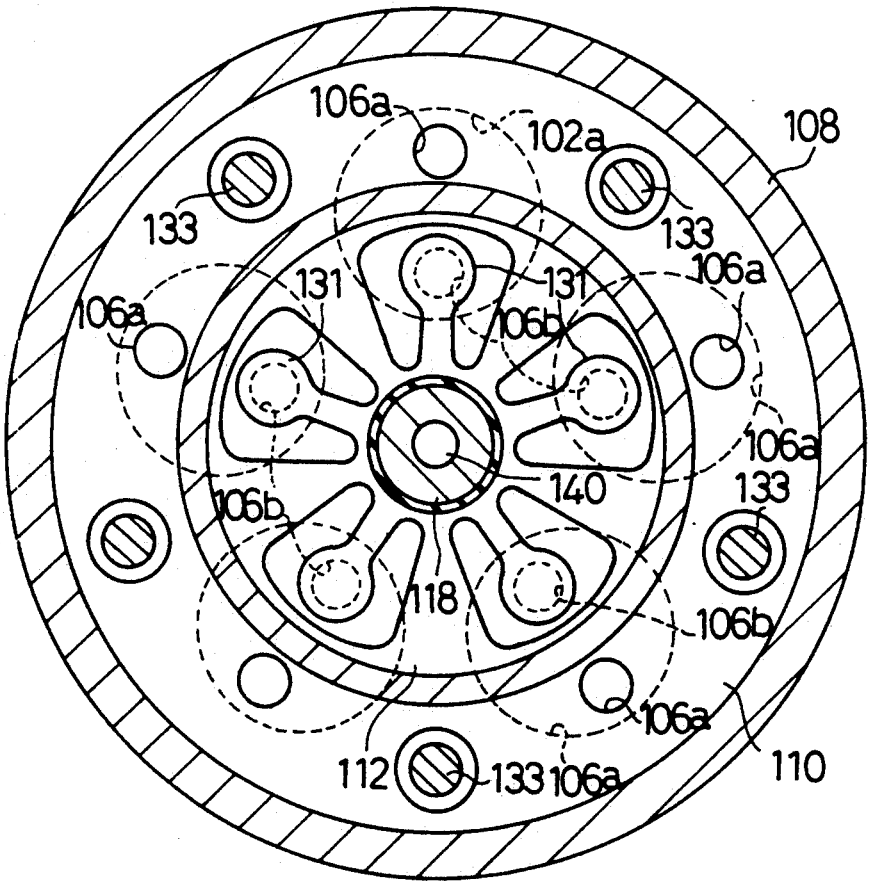
FIG. 7 is a cross sectional view of the compressor of FIG. 6, taken along line 7—7.

Referring now to FIGS. 6 to 9, the second embodiment of the present invention will now be described. As shown in FIG. 7, the discharge ports **105*b* and 106*b* are equidistantly arranged around the discharge passage 140, within imaginary circles passing the centers of the bores 101*a* and 102*a* (only the rear side is shown). The rear discharge ports 106*b* are therefore arranged at equal distances from the discharge port 128**.

Passages 160 supply a misty lubricant in the crank case 104 to the radial bearings 114 and 115, and are formed in the cylinder blocks 101 and 102. Lip type seals 161 are disposed between the drive shaft 118 and the valve plates 105 and 106, in order to prevent the refrigerant from leaking to the discharge chamber from the gaps between the drive shaft 118 and the valve plates 105 and 106. Each of the lip type seals 161 has a generally conical or skirt-like shape, with their small diameter portions held between the drive shaft 118 and the valve plates 105 and 106, and the larger diameter portions abutting against the outer surface of the radial bearings 114 and 115.

In this embodiment, as in the first embodiment, the seals 161 separate the discharge chambers 111 and 112 and the crank case 104. The refrigerant is therefore prevented from leaking to the crank case 104 from each discharge chamber.

In addition, since the individual front discharge ports **105*b* are arranged equidistantly from the discharge passage 140, the refrigerant gas discharged from the discharge ports 105*b* smoothly flows into the through holes 140*a*. As the opening of the discharge passage 140 faces the discharge port 128, the refrigerant gas is discharged smoothly from the discharge port 128** to an external refrigerant gas pipe.

The rear discharge ports **106*b* are equidistantly disposed from the discharge port 128, such that the refrigerant gas discharged from each discharge port 106*b* also flows smoothly toward the discharge port 128**.

Figure 9:
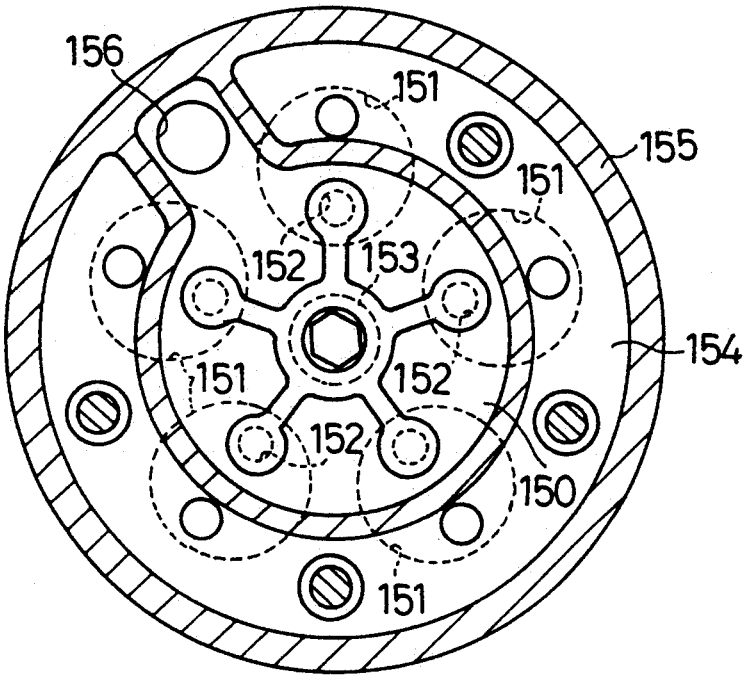
Fig.9 (Prior Art)
FIG. 9 is a cross sectional view illustrating the disposition of the discharge ports and a discharge passage in a conventional compressor.

FIG. 9 illustrates a conventional compressor having a plurality of discharge ports 152 which connect a discharge chamber 150 to compression chambers (bores) 151, and which are arranged on the same circumference around a drive shaft 153. When the discharge chamber 150 is arranged inward of a suction chamber 154, part of the discharge chamber 150 projects near the outer periphery of a housing 155, and communicates at that projecting portion, with a discharge passage 156 formed in the cylinder blocks.

In the conventional compressor, therefore, the individual discharge ports 152 are not equidistant from the discharge passage 156. The refrigerant discharged into the discharge chamber 150 does not flow smoothly toward the discharge passage 156, which causes inevitable power loss due to the discharge resistance. Meanwhile, when the discharge chamber is arranged outward of the suction chamber, such power loss was likewise inevitable. To reduce the power loss due to the discharge resistance, it is considered necessary to enlarge the diameter of the discharge passage in the conventional swash plate type compressor; a minimum of 8 mm is secured for that diameter. This will increase the overall size of the compressor.

According to the present embodiment, the refrigerant discharged to the front and rear discharge chambers 111 and 112 smoothly flows toward the discharge port 128, as described above. This suppresses the discharging resistance, and lowers the power loss. With the minimum diameter of the discharge port of the conventional compressor set equal to the diameter of the discharge passage 140 of the compressor of this embodiment, the conventional compressor and the compressor of this embodiment were operated under the same operation conditions, such as the discharging pressure, suction pressure and the number of rotations. The result is that the compressor of the present embodiment has a lower loss than the conventional compressor by about two percent to 3 percent.

Furthermore, the conventional compressor requires that the cross-sectional area of the discharge passage be increased to suppress the discharging resistance. Reducing that cross-sectional area increases the discharge resistance, and lowers the volume efficiency of the compressor, i.e. the theoretical ratio of the discharge volume of the refrigerant to the actual volume discharged. With the discharge passage 140 formed in the drive shaft 118 and the discharge ports 105b and 106b arranged equidistant from the discharge passage 140 as in this embodiment, however, it was proven that the volume efficiency does not drop significantly, even if the diameter of the discharge passage 140 or the cross-sectional area thereof is reduced.

Figure 8:
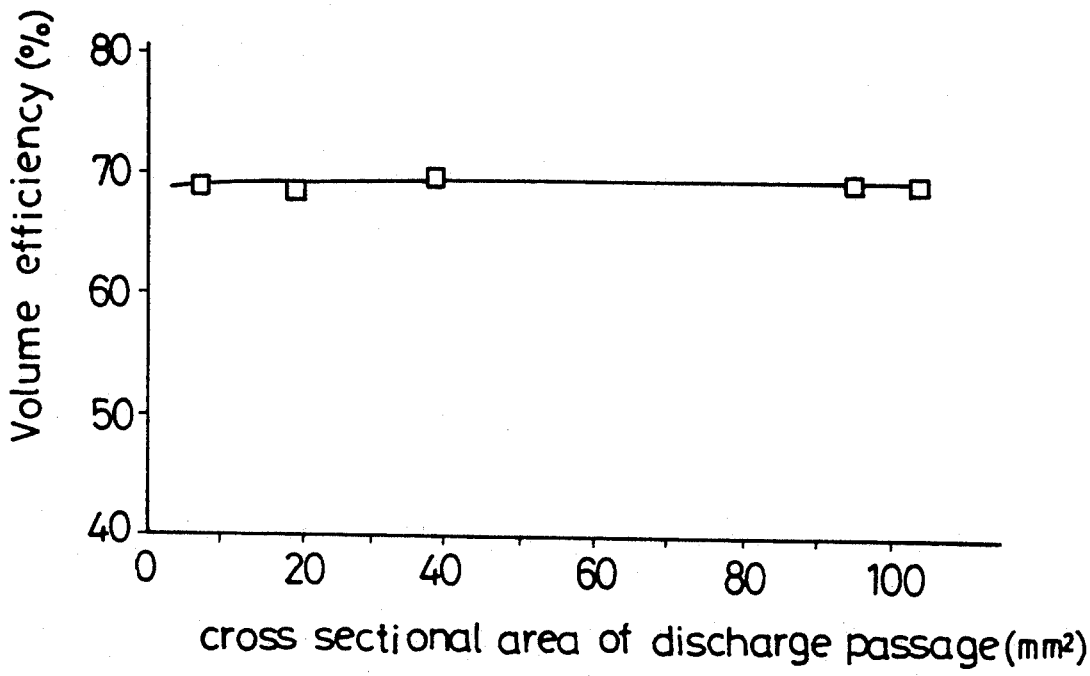
FIG. 8 is a graph showing the relationship between the cross-sectional area of a discharge passage and the volume efficiency.

For instance, under the operation conditions of the discharging pressure Pd=15 kg/cm$^2$, the suction pressure Ps=2 kg/cm$^2$, and the number of rotations of 1000 rpm, the volume efficiency was measured for different cross-sectional areas of the discharge passage 140. FIG. 8 exemplifies the results. It is apparent from FIG. 8 that the volume efficiency hardly drops even if the diameter of the discharge pasage 140 is set to 3 mm (cross-sectional area of 7 mm$^2$), maintaining the level to about 70%.

With the discharge passage 140 formed in the drive shaft 118, if the cross-sectional area needs to be increased, the diameter of the drive shaft 118, should be increased accordingly, to secure the mechanical strength of the drive shaft 118. This increases the size of the compressor. As the volume efficiency does not decrease substantially, even with a smaller diameter of the discharge passage in this embodiment, the mechanical strength of the drive shaft 118 can be maintained without making it thicker. The present embodiment will therefore not increase the size of the compressor.

In general, a swash plate type compressor causes a discharge pulsation in accordance with the number of cylinders, and vibration and noise occur accordingly. Conventionally, a muffler is provided for the discharged refrigerant gas, in order to reduce the discharge pulsation. With the discharge passage 140 provided in the drive shaft 118 as in this embodiment, however, the refrigerant gas discharged to the discharge chamber 111 from the front bores 101a is discharged from the discharge port 128 through the discharge passage 140 and the rear discharge chamber 112. At the time the refrigerant is discharged from the discharge passage 140 to the discharge chamber 112, that refrigerant is expanded in the discharge chamber 112, to yield a greater muffler effect, thus reducing the discharge pulsation.

The present embodiment therefore does not need to have a separate muffler to prevent discharged pulsation of the refrigerant on the front side. The muffler to be attached to the compressor suffices to minimize or prevent the discharge pulsation of the refrigerant on the rear side, thus making it possible to reduce the size of the compressor. In this case, it might be desirable to reduce the cross sectional dimension of the passage 140. For instance, when the capacity of the compressor is 150 cc, the diameter of the passage 140 could be 5 mm or less.

The discharge port 128 of the present embodiment may be replaced with another discharge port that is shifted sidewards from the central axis of the discharge passage 140. In this case, the smooth flow of the refrigerant on the front side can be secured.

A third embodiment of the present invention will now be described with reference to FIGS. 10 through 20.

Figure 10:
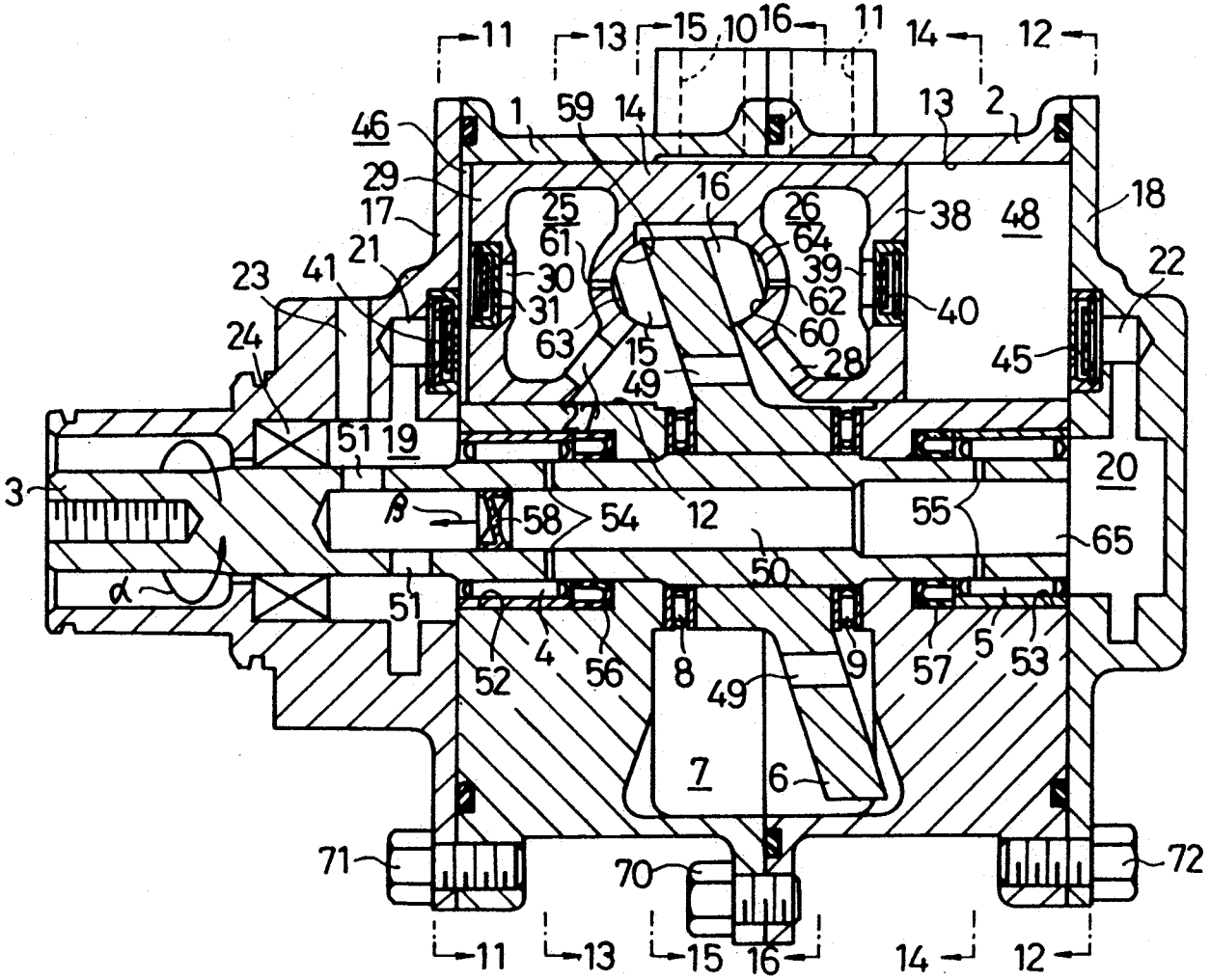
FIG. 10 is a cross-sectional side view of a swash plate type compressor according to a third embodiment of the present invention.

As shown in FIG. 10, the front and rear cylinder blocks 1 and 2 are coupled together by bolts 70. A drive shaft 3 is rotatably fitted in the cylinder blocks 1 and 2, via radial bearings 4 and 5. A swash plate 6 is fixed to the drive shaft 3. The cylinder blocks 1 and 2 define a crank case 7. Thrust bearings 8 and 9 are disposed between the swash plate 6 and the end faces of the individual cylinder blocks 1 and 2. The cylinder blocks 1 and 2 are respectively provided with refrigerant inlet ports 10 and 11 to which refrigerant gas pipes (not shown) are connected.

As shown in FIGS. 11 to 16, a plurality of cylinders 12 are equidistantly formed in the cylinder block 1 around the drive shaft 3, and a plurality of cylinders 13 are similarly formed in the cylinder block 2. As shown in FIG. 10, a two-head piston 14 is retained in a reciprocative manner in each pair of front and rear cylinders 12 and 13. Semispherical shoes 15 and 16 are disposed between the piston 14 and the swash plate 6. As the swash plate 6 rotates, the piston 14 reciprocates forward and backward in the associated cylinders 12 and 13.

The shoes 15 and 16 are respectively fitted in the recesses 59 and 60 of the piston 14. A pair of suction chambers 25 and 26 are defined in each piston 14. The recesses 59 and 60 communicate with the suction chambers 25 and 26 through oil passages 61 and 62. Part of the spherical portion of each shoe 15 and 16 is flat, and the gaps (or oil sumps) defined between these flat surfaces and the recesses 59 and 60 always communicate with the oil passages 61 and 62, respectively.

A front cover 17 is securely fastened to the outer end of the cylinder block 1 by bolts 71. Likewise, a rear cover 18 is securely fastened to the outer end of the cylinder block 2 by bolts 72. In both covers 17 and 18 are formed discharge chambers 19 and 20, which are connected to the cylinders 12 and 13, via discharge ports 21 and 22 on the covers 17 and 18. The discharge chamber 19 communicates with an external refrigerant gas pipe (not shown) via a discharge passage 23.

A lip type seal 24 is provided on the front outer surface of the drive shaft 3 to prevent the refrigerant gas from leaking outside the compressor from the discharge chamber 19. The suction chambers 25 and 26 communicate with the crank case 7 via inlets 27 and 28 formed in each piston 14. The refrigerant gas in the crank case 7 can therefore flow through the inlets 27 and 28 into the suction chambers 25 and 26, respectively.

Figure 15:
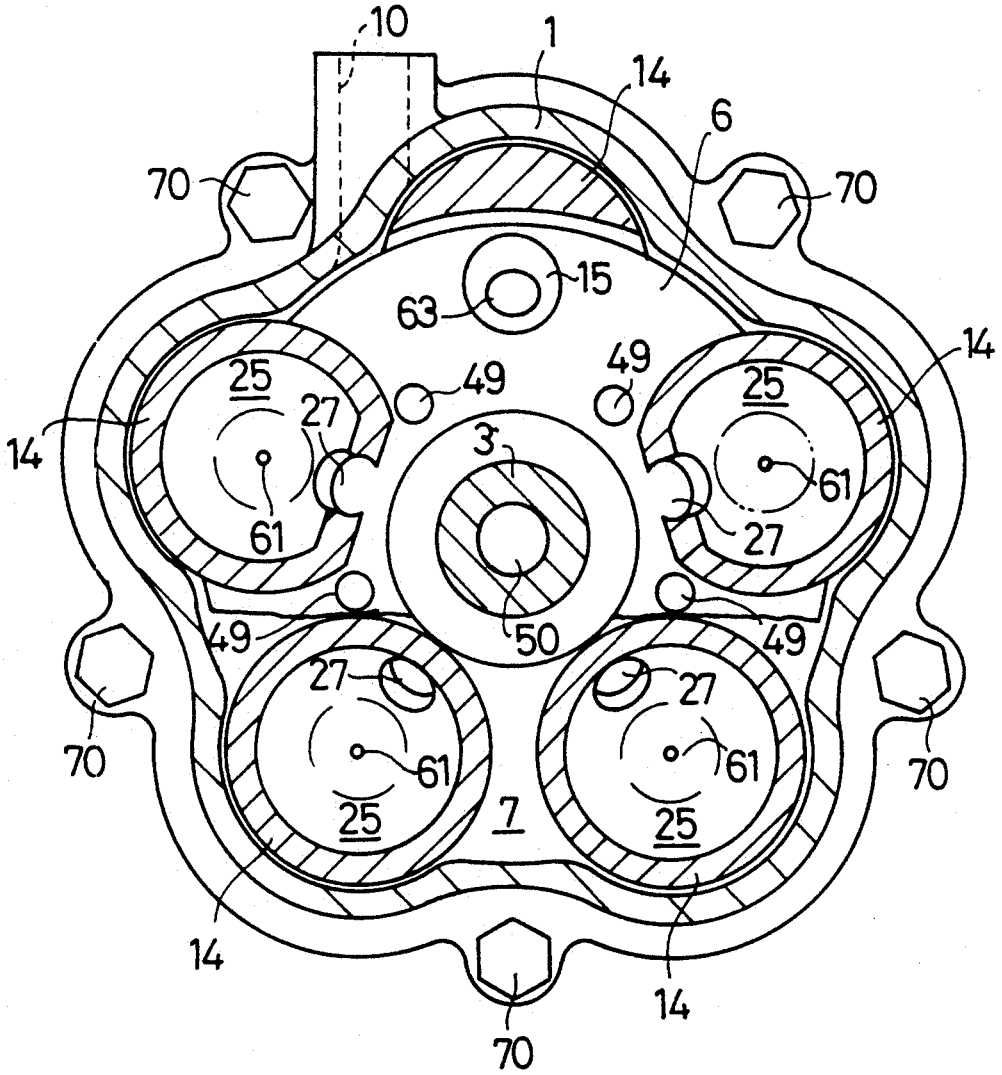
FIG. 15 is a cross sectional view of the compressor of FIG. 10, taken along line 15—15.
Figure 16:
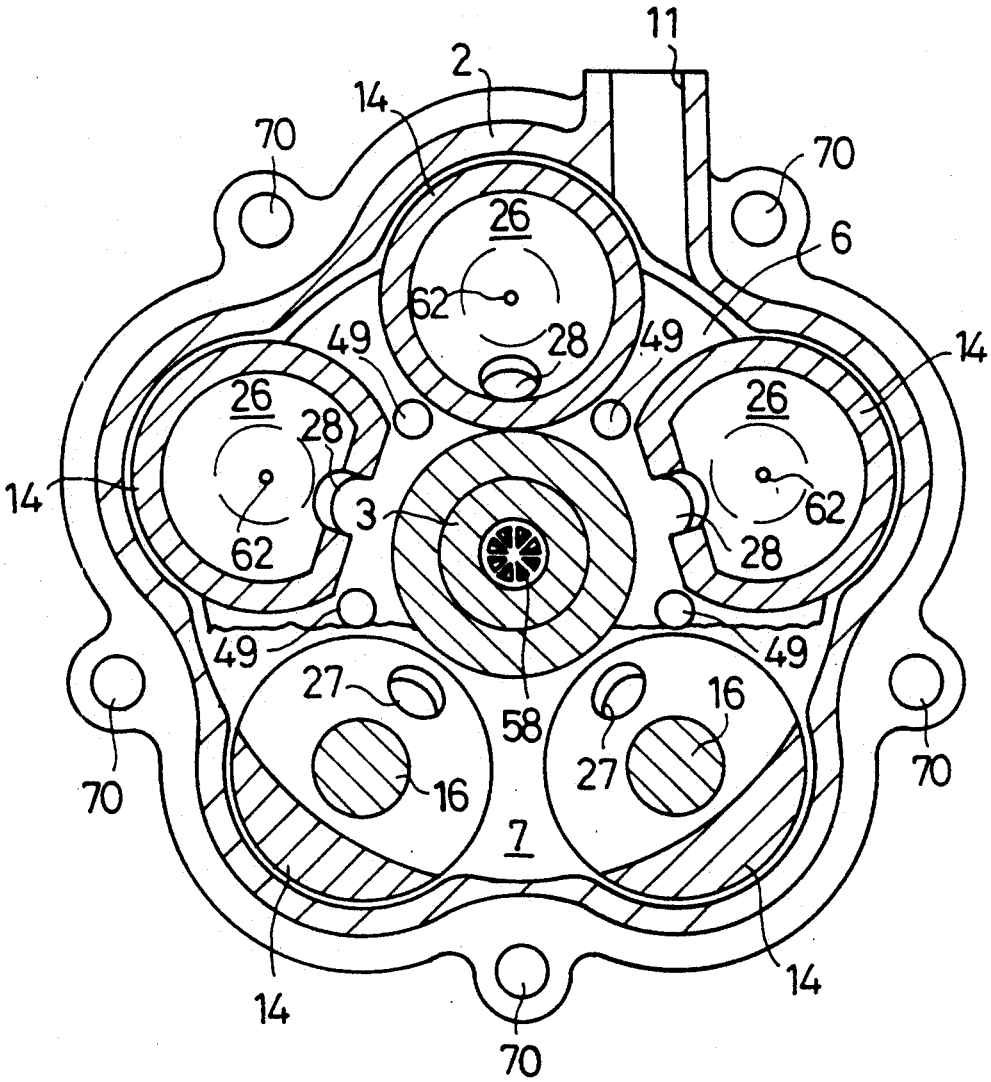
FIG. 16 is a cross sectional view of the compressor of FIG. 10, taken along line 16—16.

As shown in FIGS. 10, 15 and 16, the swash plate 6 is provided with a plurality of passages 49 which are formed horizontally within the swash plate 6. The passages 49 are arranged at predetermined distances around the drive shaft 3. The passages 49 facing the inlet ports 27 and 28 serve to smoothly guide the refrigerant gas in the crank case 7.

Figure 17:
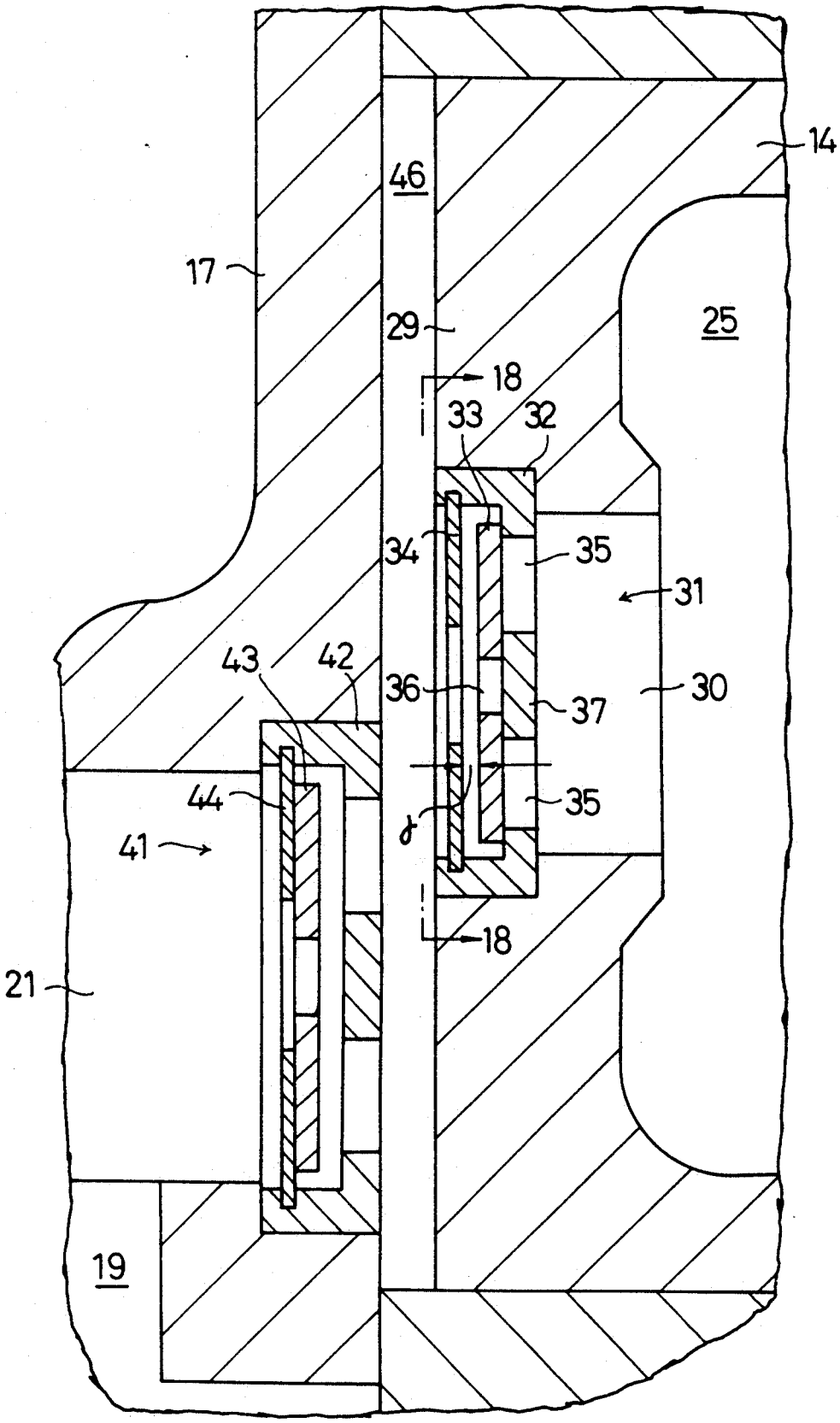
FIG. 17 is an enlarged cross-sectional side view of a discharge valve and a float valve for use in the compressor of FIG. 11.
Figure 18:
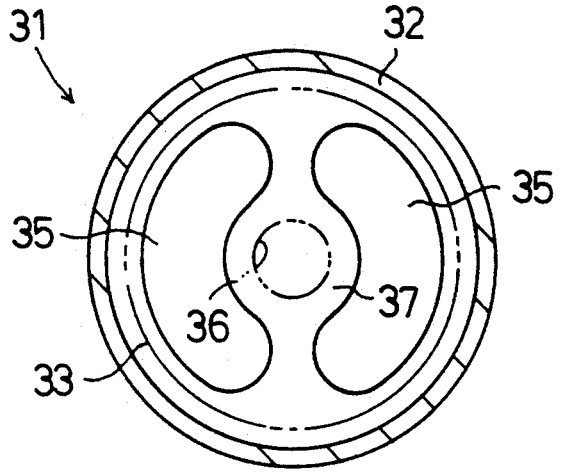
FIG. 18 is a cross sectional view of the compressor of FIG. 17, taken along line 18—18.
Figure 19:
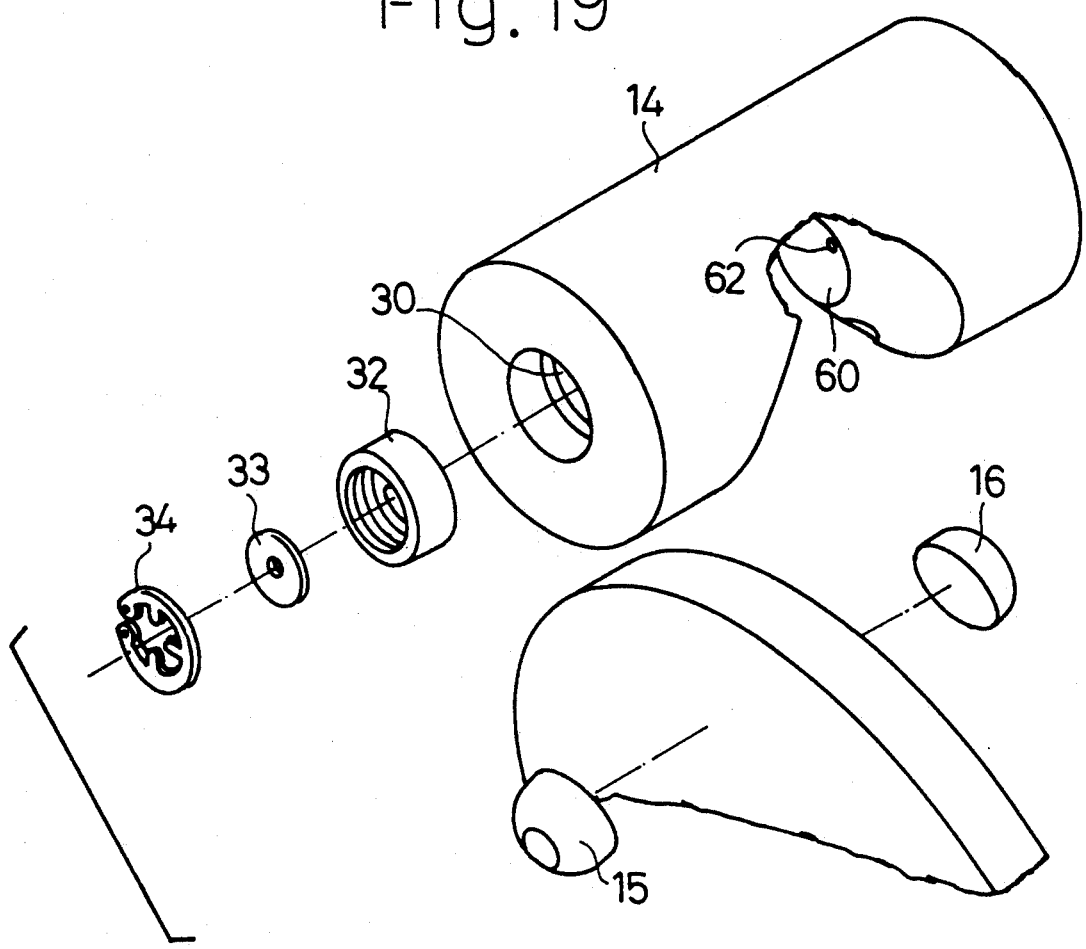
FIG. 19 is an exploded perspective view of a swash plate, a two-headed piston and a suction valve for use in the compressor of FIG. 11.

A suction port 30 is formed through a front head end 29 of each piston 14. A suction valve 31 is attached to the suction port 30. As shown in FIGS. 17 and 19, the suction valve 31 includes a valve seat 32 securely fitted in the front head end 29, a disk-shaped float valve 33 retained in the valve seat 32, and a retainer 34 (FIG. 19) for retaining and holding the float valve 33 in the valve seat 32. The valve seat 32 has a pair of openings formed therein as shown in FIG. 18. Each opening 35 is opened and closed by the float valve 33. A hole 36 is formed in the central portion of the float valve 33. With the openings 35 closed by the float valve 33, the hole 36 is closed by a bridging portion 37 located between the openings 35.

A suction port 39 is formed through a rear head end 38 of each piston 14. A suction valve 40 similar to the suction valve 31 is attached to the suction port 39. A discharge valve 41 is attached to the discharge port 21. As shown in FIG. 17, the discharge valve 41 includes a valve seat 42 securely fitted in the front cover 17, a disk-shaped float valve 43 retained in the valve seat 42, and a retainer 44 for retaining and holding the float valve 43 in the valve seat 42. The valve seat 42, float valve 43 and retainer 44 have the same shapes as the valve seat 32, float valve 33 and retainer 34 of the suction valve 31.

A discharge valve 45 similar to the discharge valve 41 is attached to the discharge port 22. At the time the head end 29 of each piston 14 makes a backward movement (when the piston 14 moves toward the rear side), the refrigerant gas in the suction chamber 25 pushes back the float valve 33, to open the openings 35, so that the gas is drawn into the compression chamber 46, between the head end 29 and the front cover 17. The movement of the float valve 33 is restricted by its position against the retainer 34. At the time the head end 29 of the piston 14 makes a forward movement (when the piston 14 moves toward the front side), the refrigerant gas in the compression chamber 46 pushes back the float valve 43 to open the openings of the valve seat 42, so that the gas is discharged into the discharge chamber 19. The movement of the float valve 43 is restricted by its position against the retainer 44.

The suction and discharge of the refrigerant are similarly carried out, via a suction valve 40 and a discharge valve 45, with respect to a compression chamber 48 defined between the other head end 38 of the piston 14 and the rear cover 18.

The drive shaft 3 has one end protruding outward from the front cover 17, and the other end projecting into the discharge chamber 20 on the rear cover side. A discharge passage 50 is formed in the axial central portion of the drive shaft 3, and is open to the discharge chamber 20. A plurality of outlets 51 extend radially, are formed in part of the drive shaft 3, and are located in the discharge chamber 19 on the front cover side. The outlets 51 allow the discharge chamber 19 to communicate with the discharge passage 50.

The radial bearings 4 and 5 are retained in annular recesses 52 and 53 of the respective cylinder blocks 1 and 2. Oil passages 54 and 55 supply a lubricant to the radial bearings 4 and 5, and are formed in those portions of the drive shaft 3 which are located in the recesses 52 and 53. A plurality of ring-shaped seals 56 and 57 are retained in respective recesses 52 and 53 inwardly of the associated radial bearings 4 and 5. The seals 56 and 57 sealingly separate the crank case 7 from the discharge chambers 19 and 20.

Figure 11:
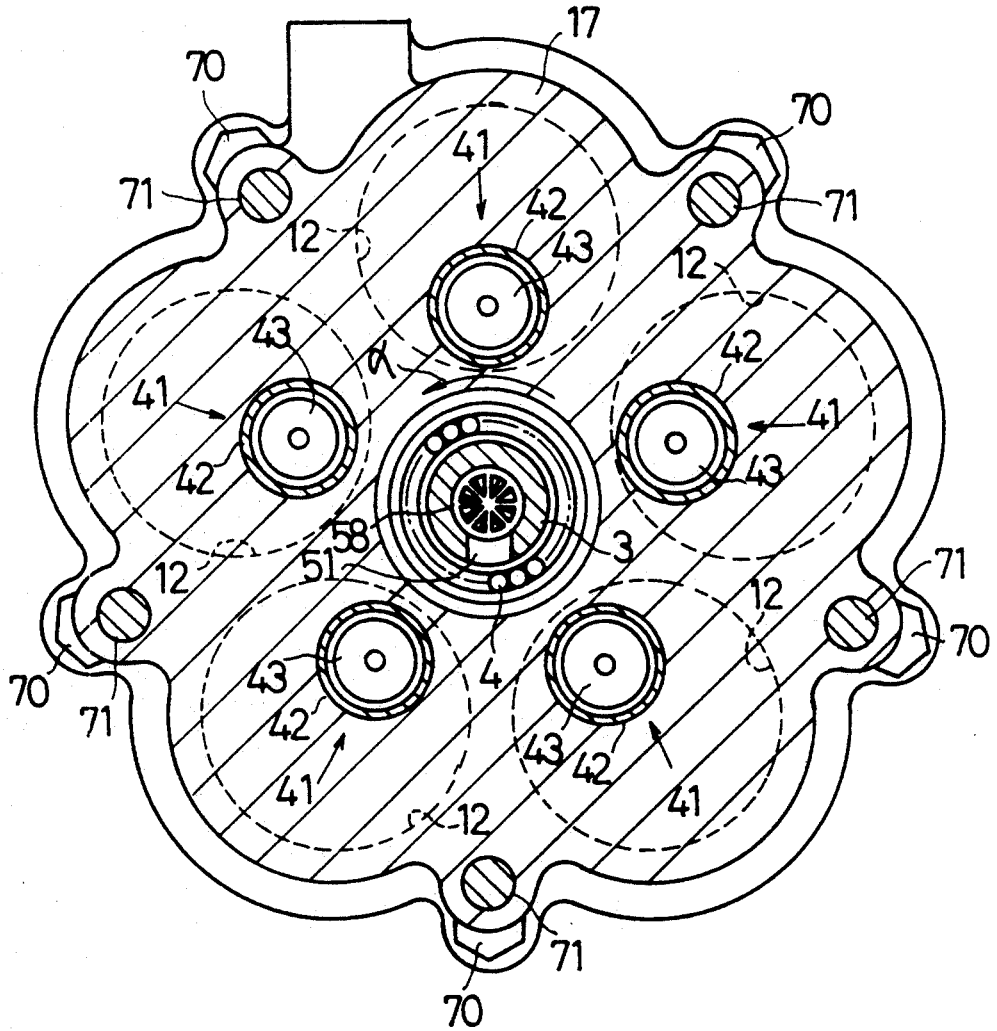
FIG. 11 is a cross sectional view of the compressor of FIG. 10, taken along line 11—11.
Figure 12:
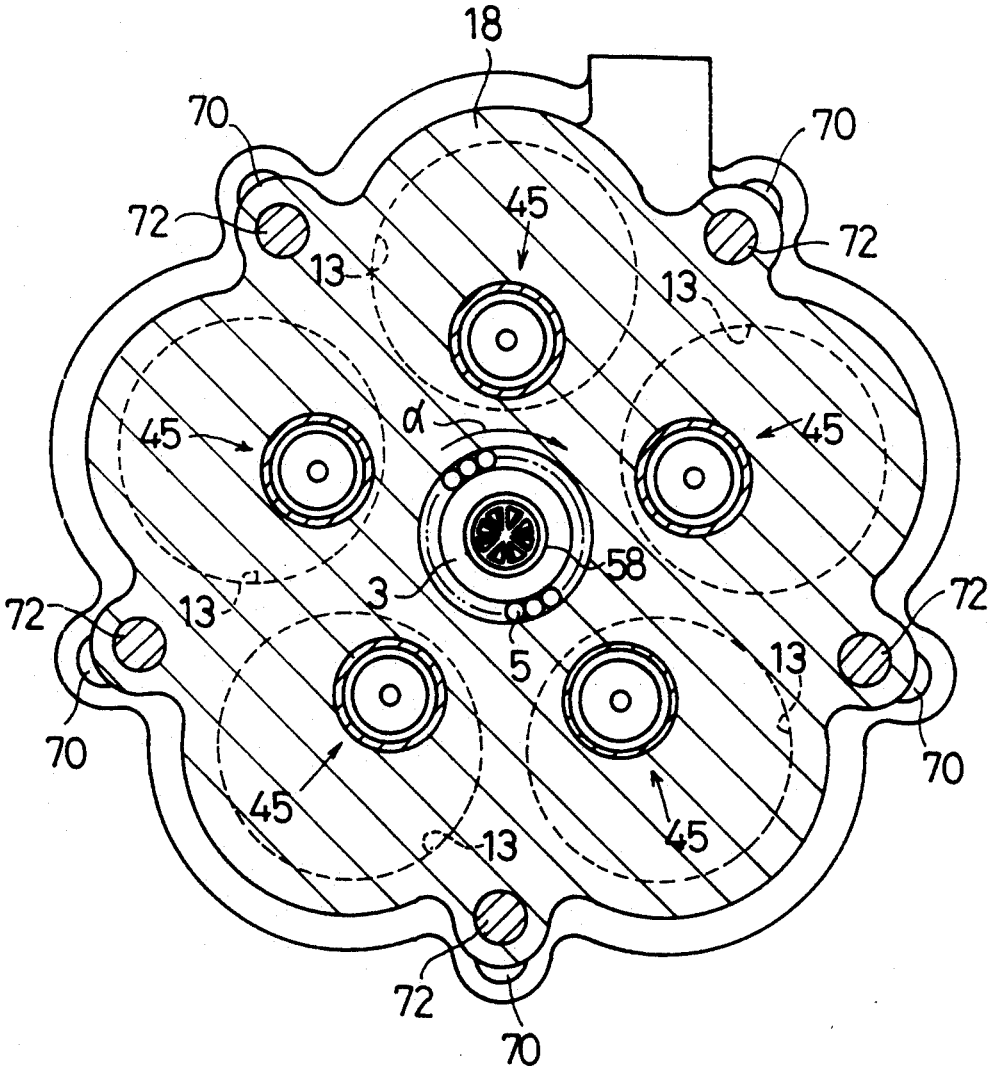
FIG. 12 is a cross sectional view of the compressor of FIG. 10, taken along line 12—12.
Figure 13:
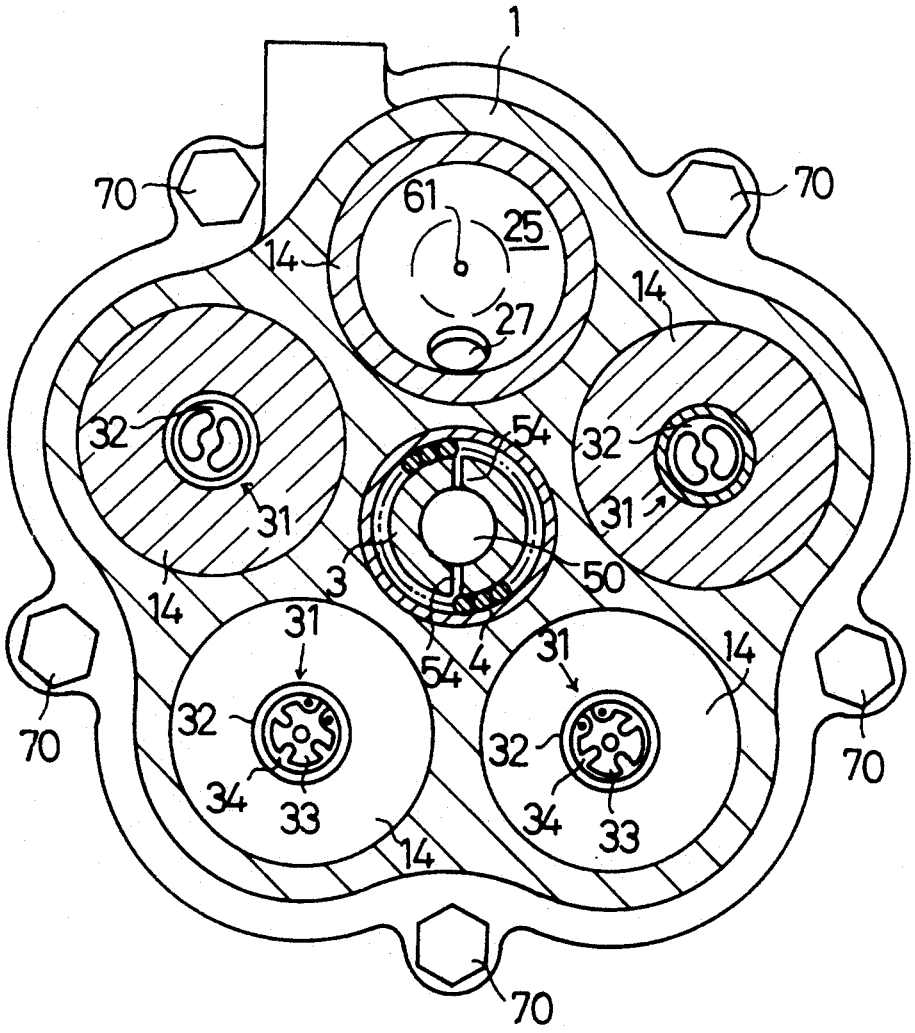
FIG. 13 is a cross sectional view of the compressor of FIG. 10, taken along line 13—13.
Figure 14:
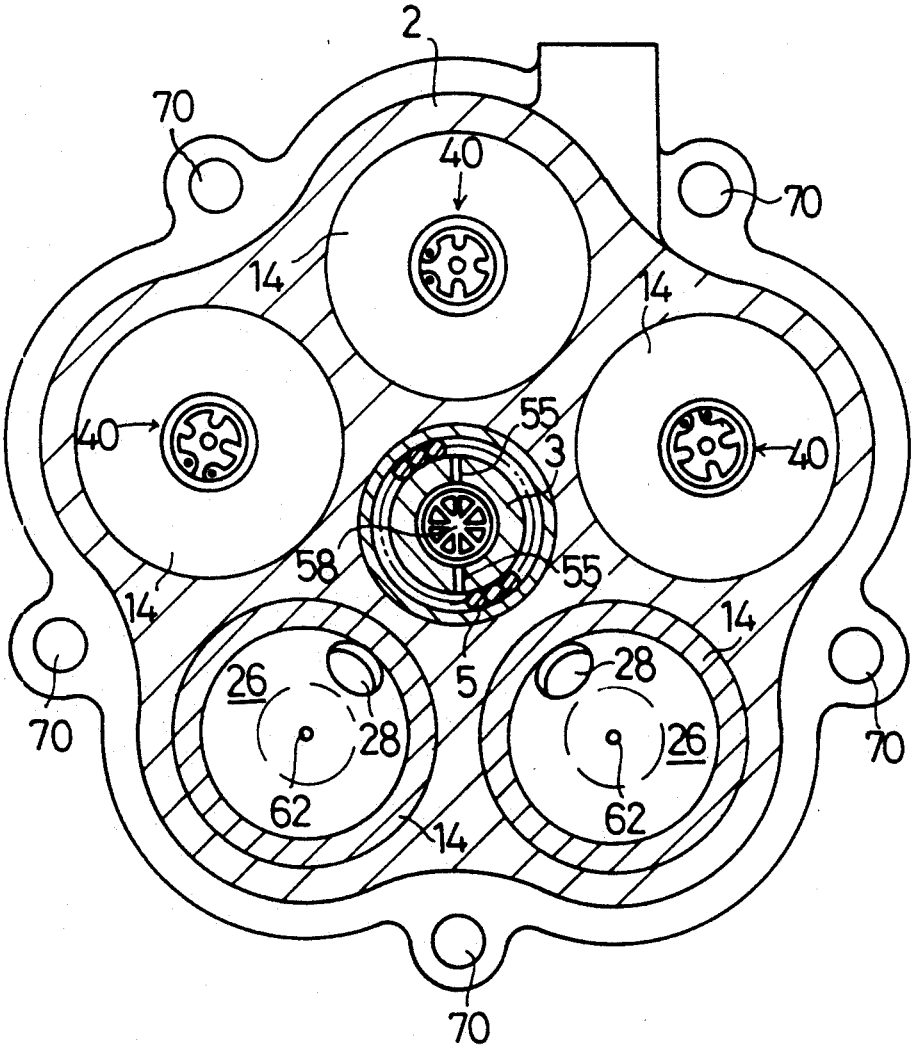
FIG. 14 is a cross sectional view of the compressor of FIG. 10, taken along line 14—14.

A wing 58 is securely fixed to the discharge passage 50. As shown in FIGS. 10 through 12, when the drive shaft 3 rotates in the direction of the arrow $\alpha$, the wing 58 forces air to flow in the direction of the arrow $\beta$.

The refrigerant gas is led into the crank case 7 from the external refrigerant gas pipe, and the refrigerant gas in the crank case 7 enters the suction chambers 25 and 26 via the inlet ports 27 and 28. The refrigerant gases in the suction chambers 25 and 26 are drawn into the compression chambers 46 and 48, via the suction ports 30 and 39, and push back the float valves 33 and 43, in accordance with the movement of the pistons 14. The refrigerant gases in the compression chambers 46 and 48 are discharged into the discharge chambers 19 and 20 via the discharge ports 21 and 22, and push back the float valve 43, in accordance with the movement of the pistons 14. The refrigerant gas in the discharge chamber 20 enters the discharge passage 50 through an opening 65.

The refrigerant gas having entered the discharge passage 50 from the discharge chamber 20, flows out to the discharge chamber 19 from the outlets 51 by the action of the wing 58. The refrigerant gas in the discharge chamber 19 is discharged, via the discharge passage 23, to the external refrigerant gas pipe.

Conventionally, a single suction passage is provided between each pair of adjoining cylinders in each cylinder block. Such suction passages could reduce the strength of the cylinder block. Further, the discharge passage is also provided in the cylinder block. The distance between the cylinders is therefore increased such that the required strength of the cylinder block can be secured. As long as the suction and discharge passages are present in the cylinder block, the distance between the cylinders cannot be optimized.

In the present embodiment, the refrigerant gas is drawn into the crank case 7, and is led into the compression chambers 46 and 48, via the suction chambers 25 and 26 in the piston 14. Unlike conventional compressors, the present compressor does not require a plurality of suction passages in the cylinder block. In the present embodiment, the refrigerant gas is discharged into the discharge chamber 20, and flows to the discharge passage 23, via the discharge passage 50 in the drive shaft 3. It eliminates the need for the discharge passage in the cylinder block, which is needed in the conventional swash plate type compressor. The elimination of the suction passages and discharge passage from the cylinder blocks 1 and 2 permits the cylinders 12 and 13 to be arranged closer to one another. The closer separation between the cylinders 12 and 13 results in a overall reduction in the diameter of each cylinder block 1 or 2. It is now possible to make the overall compressor smaller and lighter.

Unlike conventional compressors where suction chambers are provided in the front and rear cylinder blocks, the suction chambers of the present embodiment are provided within each piston 14. This inventive improvement further contributes to the overall downsizing of the compressor.

The refrigerant gas in the compression chambers 46 and 48 is discharged when the pressure becomes greater than the pressure of the refrigerant gas in the discharge chambers 19 and 20.

As the discharge chamber 19 is closed to the discharge passage 23, its pressure will not rise too high. Since the discharge chamber 20 is located remotely from the outlets 51, however, the pressure in the discharge chamber 20 depends on the discharge resistance between the discharge chamber 20 and the outlets 51.

To prevent the pressure in the discharge chamber 20 from rising too high, it would be advisable to produce force to draw in the refrigerant gas at the opening 65 of the discharge passage 50. This force is caused by causing the refrigerant gas to flow against the discharge resistance of the discharge passage lying from the discharge chamber 20 to the outlets 51. In this embodiment, the wing 58 sends the refrigerant gas in the discharge passage 50 toward the outlets 51.

Since the wing 58 is small, it slightly increases the rotational resistance of the drive shaft 3. The pressure in the discharge chamber 20 can therefore be reduced without causing any significant power loss. The reduction of the pressure in the discharge chamber 20 allows the refrigerant gas in the compression chamber 48 to be discharged to the discharge chamber 20 without being overcompressed. It is therefore possible to suppress the discharge pulsation and power loss originating from the overcompression of the refrigerant gas. As the rotational speed of the compressor increases, the volume of the circulating refrigerant gas increases so that the overcompression and discharge pulsation becomes greater in proportion to the rotational speed. The discharge assisting action of the wing 58 suppresses the overcompression in the compression chamber 48, thus suppressing the power loss and discharge pulsation at the time the compressor runs at a high speed.

When the pressure of the refrigerant gas in the compression chambers 46 and 48 fall below those in the suction chambers 25 and 26, the refrigerant gas in the suction chambers 25 and 26 is sucked into the compression chambers 46 and 48. The flow resistance in the refrigerant gas passages extending from the crank case 7 to the compression chambers 46 and 48, i.e., the suction resistance of the refrigerant gas, affects the pressures in the suction chambers 25 and 26. The higher the suction resistance is, the larger the suction pulsation and power loss.

The foregoing suction resistance mainly depends on the suction resistances at the suction ports 30 and 39 in the limited regions, namely, on the head ends 29 and 38 of the piston 14. The suction resistances at the suction ports 30 and 39 can be reduced by increasing the cross-sectional areas of the suction valves 31 and 40. The float valve 33, which includes the suction valve 31 or 40, makes almost a parallel movement between the valve seat 32 and the retainer 34. Given that the parallel displacement of the float valve 33 is $\gamma$, as shown in FIG. 17, and the inner circumferential length thereof is $\epsilon$, the refrigerant-passing cross-sectional area of the suction valve 31 or 40 is expressed by $\gamma\epsilon$.

The suction valve in the conventional compressor is an overhang type valve plate so that deflection of the valve plate opens the suction port. The cross-sectional area of such suction valve is approximately one half that of the suction valve 31 or 40 in the present embodiment, if the amount of deflection of the valve plate is equal to the parallel displacement of the float valve 33.

An increase in the amount of deformation of the valve plate increases the suction valve cross-sectional area. If such valve plate is used on the head end 29 or 38, it causes the size of the piston 14 to increase. Even if the displacement of the float valve 33 is set less than the amount of deflection of the valve plate, the cross-sectional area of the suction valve 31 or 40 becomes greater than that of the conventional suction valve, thus permitting the suction resistance to be suppressed without increasing the size of the piston 14.

Each of the discharge valves 41 and 45, which includes the float valve 43 therein, would increase the cross-discharge ports 21 and 22, or would reduce the discharge resistance without increasing the thicknesses of the covers 17 and 18. Therefore, the discharge valves 41 and 45, together with the wing 58 contribute to the reduction of the discharge pulsation and power loss.

As a misty lubricant is mixed to the refrigerant gas, the lubricant will stick on the wall of the discharge passage 50. Part of the lubricant on the wall of the discharge passage 50 enters the recesses 52 and 53 from the oil passages 54 and 55 by the centrifugal force created by the rotation of the drive shaft 3, for ensuring a smooth lubrication of the radial bearings 4 and 5.

The misty lubricant in the refrigerant will stick on the walls of the suction chambers 25 and 26 in the piston 14. The lubricant enters the gaps 63 and 64 from the oil passages 61 and 62 due to the reciprocation of the piston 14. The sliding portions between the recesses 59 and 60 and the shoes 15 and 16 are lubricated, for preventing the sliding portions from being burnt. Although the gaps 63 and 64 serve as oil wells, the lubrication between the shoes 15 and 16 and the recesses 59 and 60 could occur without the gaps 63 and 64.

The recess 52 is connected to the discharge chamber 19 along the outer surface of the drive shaft 3, and the recess 53 to the discharge chamber 20 along the outer surface of the drive shaft 3. Therefore, there is some concern that the refrigerant gas might leak to the crank case 7 along the outer surface of the drive shaft 3. However, the seals 56 and 57 are provided between the crank case 7 and the recesses 52 and 53, and come into close contact with the outer surface of the drive shaft 3 and the inner walls of the recesses 52 and 53, under pressure from the refrigerant gas. This design can thus prevent the discharged refrigerant gas from leaking to the crank case 7 along the outer surface of the drive shaft 3.

Figure 20:
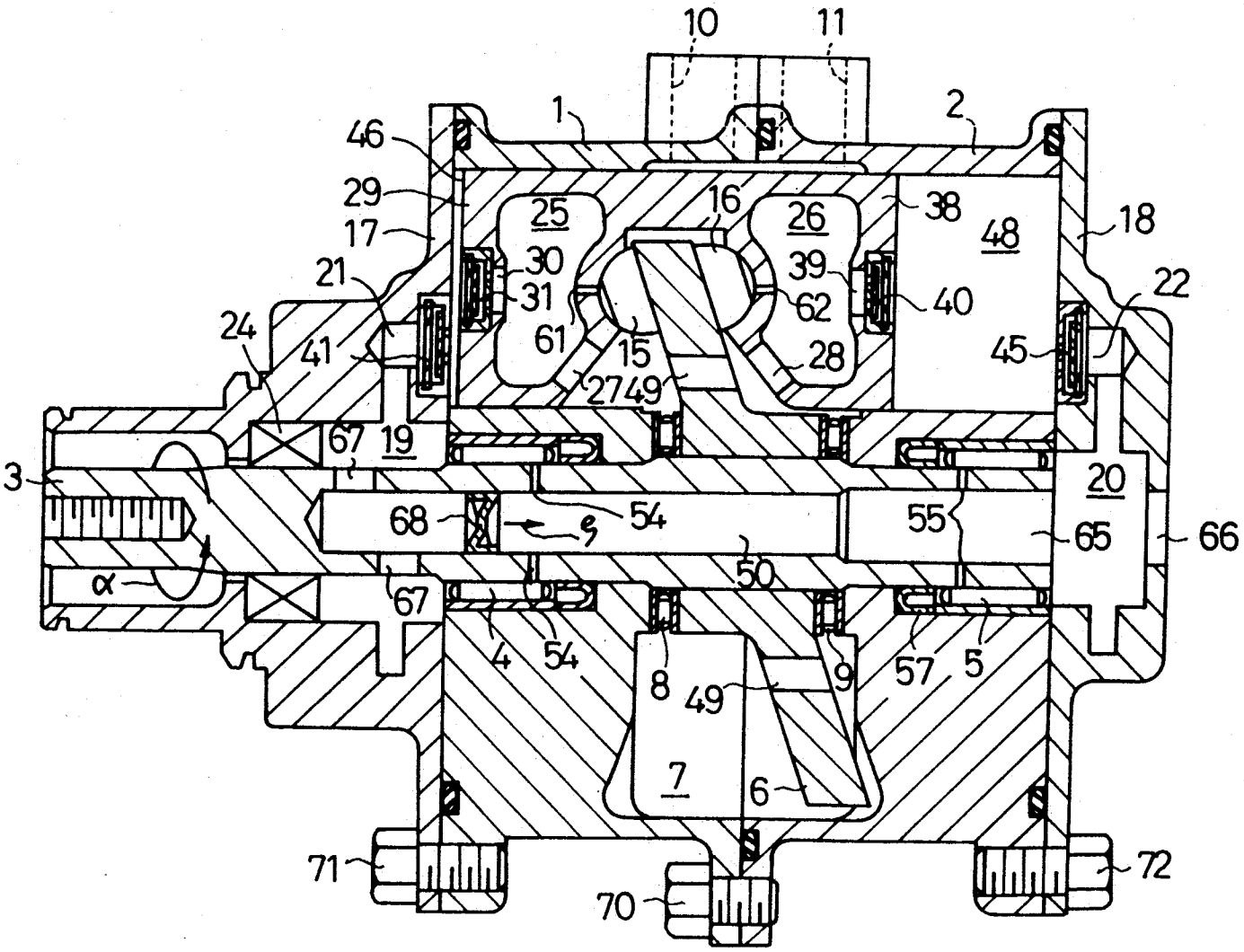
FIG. 20 is a cross-sectional side view of the entire compressor according to yet another embodiment according to the present invention.

The present invention is not limited to the above-described embodiments, but the structure may be modified as shown in FIG. 20.

In this modification, an outlet 66 is formed in the rear cover 18, facing the opening 65 of the drive shaft 3. An external refrigerant gas pipe (not shown) is connected to the outlet 66. Inlet ports 67 are formed in that portion of the drive shaft 3 which is located in the discharge chamber 19. The inlet ports 67 permit the discharge chamber 19 to communicate with the discharge passage 50. A wing 68 is securely fitted in the discharge passage 50. As the drive shaft 3 rotates in the direction of an arrow $\alpha$, the wing 68 feeds air in the direction of an arrow $\zeta$, as shown in FIG. 20.

The refrigerant gas in the compression chambers 46 and 48 is discharged to the discharge chambers 19 and 20 from the discharge ports 21 and 22, in accordance with the movement of the piston 14. The refrigerant gas discharged to the discharge chamber 19 enters the discharge passage 50 from the inlet ports 67. The refrigerant gas discharged to the discharge chamber 20 from the discharge port 22 is discharged directly from the outlet port 66.

Due to the long distance between the discharge chamber 19 and the outlet port 66, the discharge resistance therebetween affects the pressure in the discharge chamber 19. To prevent the pressure in the discharge chambers 19 and 20 from rising too high, it would be desirable to produce a suction action at the inlet ports 67, with a suction force from the discharge chamber 20 to the outlet port 66. The sucking force is caused by causing the refrigerant gas to flow against the discharge resistance of the passage lying from the discharge chamber 19 to the outlet port 66. In this embodiment, the wing 58 forces the refrigerant gas in the discharge passage 50 toward the outlet port 66.

What is claimed is:

1. In a swash plate type compressor having a cylinder block which includes a crank case disposed between axially extending bores arranged in coaxial pairs, a two-headed piston disposed for reciprocal movement in each of said pairs of bores, a rotatable drive shaft mounted within said cylinder block passing through said crank case and projecting from at least one end of said cylinder block, a swash plate mounted on said drive shaft within said crank case for rotation with said shaft, means coupling said swash plate in driving relation to said pistons for cyclically compressing a refrigerant and causing it to be discharged, and at least one discharge chamber located at each opposite axial end of said cylinder block, the improvement comprising:

a longitudinal passage formed along the axis of said drive shaft and interconnecting said discharge chambers for conveying refrigerant therebetween; and seal members disposed between said cylinder block and said drive shaft for sealing paths between said crank case and said discharge chambers.

2. The swash plate type compressor according to claim 1, further including a plurality of bearings disposed between said cylinder block and said drive shaft for supporting said drive shaft, and a plurality of recesses formed in said cylinder block surrounding said drive shaft for retaining said bearings and seal members.

3. The swash plate type compressor according to claim 2, wherein said recesses each have a bottom, and wherein said seal members are each retained at said bottom of a respective recess, and said bearings are retained close to said seal members.

4. The swash plate type compressor according to claim 1, wherein each of said seal members has a ring-shape and a generally U-shaped cross section disposed such that the open ends of said U-shaped seal member faces a corresponding one of said discharge chambers.

5. The swash plate type compressor according to claim 1, further including a plurality of discharge ports in said cylinder block for connecting said cylinder bores to said discharge chambers, and wherein said discharge ports are equidistantly arranged with respect to said passage in said shaft.

6. The swash plate type compressor according to claim 3, wherein said drive shaft includes a plurality of laterally extending lubricant passages for interconnecting said longitudinal passage with each of said recesses for supplying a lubricant to said bearings.

7. In a swash plate type compressor having a cylinder block which includes a crank case disposed between axially extending bores arranged in coaxial pairs, a two-headed piston disposed for reciprocal movement in each of said pairs of bores, a rotatable drive shaft mounted within said cylinder block passing through said crank case and projecting from at least one end of said cylinder block, a swash plate mounted on said drive shaft within said crank case for rotation with said shaft, means coupling said swash plate in driving relation to said pistons for cyclically compressing a refrigerant and causing it to be discharged, and at least one discharge chamber located at each opposite axial end of said cylinder block, the improvement comprising:

a longitudinal passage formed along the axis of said drive shaft and interconnecting said discharge chambers for conveying refrigerant therebetween; and a plurality of discharge ports in said cylinder block for connecting said cylinder bores to said discharge chambers, and wherein said discharge ports are equidistantly arranged with respect to said passage in said shaft.

8. The swash plate type compressor according to claim 7, wherein each of said discharge ports has a discharge valve for opening and closing said discharge port.

9. The swash plate type compressor according to claim 8, wherein said discharge valve comprises means for closing said discharge port when said associated piston sucks the refrigerant, and opening said discharge port when said associated piston discharges the refrigerant.

10. In a swash plate type compressor having a cylinder block which includes a crank case disposed between axially extending bores arranged in coaxial pairs, a two-headed piston disposed for reciprocal movement in each of said pairs of bores, a rotatable drive shaft mounted within said cylinder block passing through said crank case and projecting from at least one end of said cylinder block, a swash plate mounted on said drive shaft within said crank case for rotation with said shaft, means coupling said swash plate in driving relation to said pistons for cyclically compressing a refrigerant and causing it to be discharged, and at least one discharge chamber located at each opposite axial end of said cylinder block, the improvement comprising:

a longitudinal passage formed along the axis of said drive shaft and interconnecting said discharge chambers for conveying refrigerant therebetween;

a pair of suction chambers provided in each of said pistons in communication with said crank case; and a suction port provided in each of said pistons for connecting each one of said suction chambers to a corresponding one of said axially extending bores.

11. The swash plate type compressor according to claim 10, wherein each of said suction ports has a suction valve for opening and closing said suction port.

12. The swash plate type compressor according to claim 11, wherein said suction valve comprises means for opening said suction port when said associated piston sucks the refrigerant, and closing said suction port when said associated piston discharges the refrigerant.

13. The swash plate type compressor according to claim 10, further comprising a wing disposed within said drive shaft refrigerant passage for forcibly feeding the refrigerant when said drive shaft rotates.

14. The swash plate type compressor according to claim 10, further including a plurality of shoes disposed between and in rubbing engagement with said pistons and said swash plate for coupling said swash plate to said pistons with at least one different one of said shoes being adjacent each one of said suction chambers.

15. The swash plate type compressor according to claim 14, wherein each one of said pistons is provided with a passage for supplying a lubricant to an associated one of said shoes from the adjacent one of said suction chambers.

16. The swash plate type compressor according to claim 10, further including a separate recess formed in said cylinder block surrounding said drive shaft adjacent each of said at least one discharge chamber, at least one bearing disposed in each of said recesses between said cylinder block and said drive shaft, and at least one seal member disposed within each said recess for establishing a fluid seal between said cylinder block and said drive shaft.

17. The swash plate type compressor according to claim 16, wherein each of said seal members has a ring-shape and a generally U-shaped cross section disposed such that the open ends of said U-shaped seal member faces a corresponding one of said discharge chambers.

18. A compressor comprising a cylinder block which includes a crank case, at least one discharge chamber located at each opposite axial end of said cylinder block, a rotatable drive shaft mounted within said cylinder block passing through said crank case and projecting from at least one end of said cylinder block, said drive shaft having a longitudinal passage along its longitudinal axis in communication with each of said discharge chambers for conveying fluid between said discharge chambers at opposite ends of said cylinder block, and seal means disposed between said cylinder block and said drive shaft for preventing fluid flow between said discharge chambers and said crank case.

19. A method for cyclically compressing a fluid in a compressor and for causing it to be discharged through a plurality of discharge chambers, the method comprising the steps of:

passing said fluid through a generally centrally located axial passage in a drive shaft from one discharge chamber to another; and sealing a path between said discharge chambers with a plurality of sealing members disposed between said drive shaft and said discharge chambers.

* * * * *